US010127851B2

(12) United States Patent
Kim et al.

(10) Patent No.: US 10,127,851 B2
(45) Date of Patent: Nov. 13, 2018

(54) IMAGE PROCESSING METHOD OF OLED DISPLAY DEVICE

(71) Applicant: LG ELECTRONICS INC., Seoul (KR)

(72) Inventors: Jung Hwan Kim, Seoul (KR); Seung Hyun Lee, Seoul (KR); Myung Jin Park, Seoul (KR); Seung Chan Baek, Seoul (KR); Seong Hak Moon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 57 days.

(21) Appl. No.: 15/120,253

(22) PCT Filed: Jan. 28, 2015

(86) PCT No.: PCT/KR2015/000889
§ 371 (c)(1),
(2) Date: Aug. 19, 2016

(87) PCT Pub. No.: WO2015/126071
PCT Pub. Date: Aug. 27, 2015

(65) Prior Publication Data

US 2017/0069242 A1 Mar. 9, 2017

(30) Foreign Application Priority Data

Feb. 24, 2014 (KR) ..... 10-2014-0021141

(51) Int. Cl.
*G09G 3/32* (2016.01)
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2300/0452* (2013.01);
(Continued)

(58) Field of Classification Search
CPC ..... G09G 3/2003; G09G 3/3208; G09G 2300/0452; G09G 2310/08;
(Continued)

(56) References Cited

U.S. PATENT DOCUMENTS

2006/0132652 A1 6/2006 Kim
2007/0081743 A1 4/2007 Kim
(Continued)

FOREIGN PATENT DOCUMENTS

CN 102414733 A 4/2012
CN 103578412 A 2/2014
(Continued)

*Primary Examiner* — Richard Hong
(74) *Attorney, Agent, or Firm* — Birch, Stewart, Kolasch & Birch, LLP

(57) ABSTRACT

Disclosed is an image processing method for reducing power consumption of an OLED display device. A method of the present invention comprises the steps of: receiving image data; determining whether a frequency of a predetermined area of the image data is lower than a predetermined reference; deciding a minimum value among a plurality of blue data values of the predetermined area when the frequency of the predetermined area is lower than the reference as a result of the determination; and changing blue data of the predetermined area on the basis of the determined minimum value.

11 Claims, 7 Drawing Sheets

(52) U.S. Cl.
CPC . *G09G 2310/08* (2013.01); *G09G 2320/0233* (2013.01); *G09G 2320/0271* (2013.01); *G09G 2320/043* (2013.01); *G09G 2320/0666* (2013.01); *G09G 2330/021* (2013.01); *G09G 2360/16* (2013.01)

(58) Field of Classification Search
CPC ... G09G 2320/0271; G09G 2320/0666; G09G 2330/021; G09G 2360/16; G09G 2320/0233; G09G 2320/043
See application file for complete search history.

(56) References Cited

U.S. PATENT DOCUMENTS

| | | | | |
|---|---|---|---|---|
| 2009/0136127 | A1 | 5/2009 | Kwak et al. | |
| 2010/0149340 | A1 | 6/2010 | Marks et al. | |
| 2010/0225673 | A1* | 9/2010 | Miller | G09G 3/2003 345/690 |
| 2014/0184655 | A1* | 7/2014 | Jang | G09G 3/3208 345/690 |

FOREIGN PATENT DOCUMENTS

| | | | |
|---|---|---|---|
| JP | 2012-512598 | A | 5/2012 |
| KR | 10-2013-0061225 | A | 6/2013 |

* cited by examiner (a) (b)

(a) (b)

IMAGE PROCESSING METHOD OF OLED DISPLAY DEVICE

CROSS REFERENCE TO RELATED APPLICATIONS

This application is the National Phase of PCT International Application No. PCT/KR2015/000889, filed on Jan. 28, 2015, which claims priority under 35 U.S.C. 119(a) to Patent Application No. 10-2014-0021141, filed in the Republic of Korea on Feb. 24, 2014, all of which are hereby expressly incorporated by reference into the present application.

FIELD OF THE INVENTION

The teachings in accordance with the exemplary embodiments of this invention relate generally to an image processing method of OLED display device, and more particularly to an image processing method for decreasing power consumption of an OLED display device.

Recently, display devices currently being developed in technology such as televisions using OLEDs (Organic Light Emitting Diodes) employ a method of applying color filters on RGB (Red, Green, Blue) elements. This method has an advantage of being easy in processing and increasing the size to a large area but suffers from disadvantages of poor luminance and increased power consumption.

SUMMARY OF THE INVENTION

The technical subject of the present invention is directed to provide an image processing method of OLED display device by decreasing power consumption of OLED display device and improving luminance through optimization of blue data.

In order to accomplish the abovementioned technical subject, there is provided an image processing method of OLED display device, the method comprising:

receiving an image data;

determining whether a frequency in a predetermined region of the image data is smaller than a threshold;

determining a minimum value out of a plurality of blue data in the predetermined region when the frequency in the predetermined region is smaller than the threshold as a result of the determination; and changing the blue data of the predetermined region based on the determined minimum value.

Preferably, but not necessarily, the method may further comprise displaying an image data of predetermined region when the frequency of the predetermined region is greater than the threshold as a result of the determination.

Preferably, but not necessarily, the method may further comprise displaying an image data of the predetermined region including the blue data changed in response to changing steps.

Preferably, but not necessarily, the predetermined region may be comprised of a plurality of pixels, and the step of substituting the blue data of predetermined region to the minimum value may include substituting each blue data of plurality of pixels with a minimum value.

Preferably, but not necessarily, the step of changing the blue data of predetermined region based on the determined minimum value may include changing the blue data of the predetermined region to the minimum value en bloc.

Preferably, but not necessarily, the step of changing the blue data of predetermined region based on the determined minimum value may include changing the blue data of the predetermined region by differentially applying in response to size of each blue data based on the minimum value.

In another general aspect of the present disclosure, there is provided an image processing method of OLED display device, the method comprising:

receiving an image data;

determining whether a frequency in a predetermined region of the image data is smaller than a predetermined first threshold;

determining whether the frequency in the predetermined region is smaller than a predetermined second threshold when the frequency in the predetermined region is smaller than a predetermined first threshold, as a result of determination of determining whether the frequency of predetermined region of the image data is smaller than the predetermined first threshold; and decreasing the blue data of the predetermined region by a predetermined ratio in response to a result of determination of determining whether the frequency of predetermined region is smaller than the predetermined second threshold.

Preferably, but not necessarily, the method may further comprise; displaying the image data of predetermined region when the frequency of predetermined region is smaller than the predetermined first threshold as a result of determination of determining whether the frequency of predetermined region of the image data is smaller than the predetermined first threshold.

Preferably, but not necessarily, the step of decreasing the blue data of predetermined region by a predetermined ratio may include decreasing the blue data of predetermined region by a first ratio when the frequency of predetermined region is not smaller than the predetermined second threshold, and decreasing the blue data of predetermined region by a second ratio when the frequency of predetermined region is smaller than the predetermined second threshold Preferably, but not necessarily, the second threshold may be smaller than the first threshold.

Preferably, but not necessarily, the predetermined region may be comprised of a plurality of pixels, and the step of decreasing the blue data of predetermined region by a predetermined ratio may include decreasing each blue data in the plurality of pixels by a predetermined ratio.

The image processing method of OLED display device according to the present invention has advantageous effects in that power consumption can be reduced by minimizing degradation of screen quality by bypassing a data at a region classified by high frequency in response to a threshold, and by minimizing blue data in a region divided by low frequency in response to a threshold.

DETAILED DESCRIPTION OF EMBODIMENTS

The present invention may be applied with various changes, and may be included with various exemplary embodiments, and particular exemplary embodiments will be exemplified by drawings and explained in the Detailed Description. However, the present invention will not be limited to the particular exemplary embodiments, and the described aspect is intended to embrace all such alterations, modifications, and variations that fall within the scope and novel idea of the present invention.

In general, power consumption is greatly varied in response to amount of blue data in a display device using an OLED, because luminance and efficiency of blue cells are small when color is reproduced. The present invention is to decrease the power consumption through optimum blue data control using the above theory. Hereinafter, exemplary embodiments of the present invention will be described in detail with threshold to the accompanying drawings.

Figure 1:
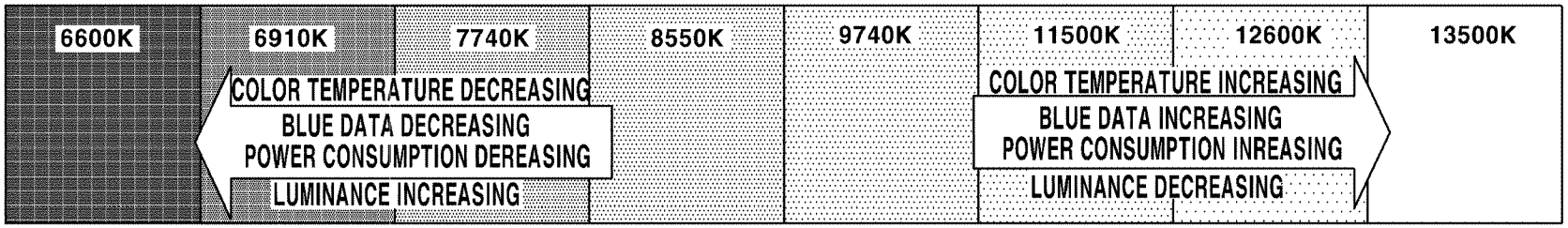
FIG. 1 is an exemplary view to explain a characteristic change of OLED display device according to a color temperature.

FIG. 1 is an exemplary view to explain a characteristic change of OLED display device according to a color temperature.

Referring to FIG. 1, luminance and power consumption are displayed differently in response to color temperature in a display device using an OLED. That is, the power consumption increases and luminance decreases in a region where color temperature is high using a large amount of blue data, and the power consumption decreases and the luminance increases in a region where color temperature is low using a small amount of blue data.

The present invention is to optimize the blue data in a particular area of image and to decrease the power consumption using the above described characteristics.

Figure 2:
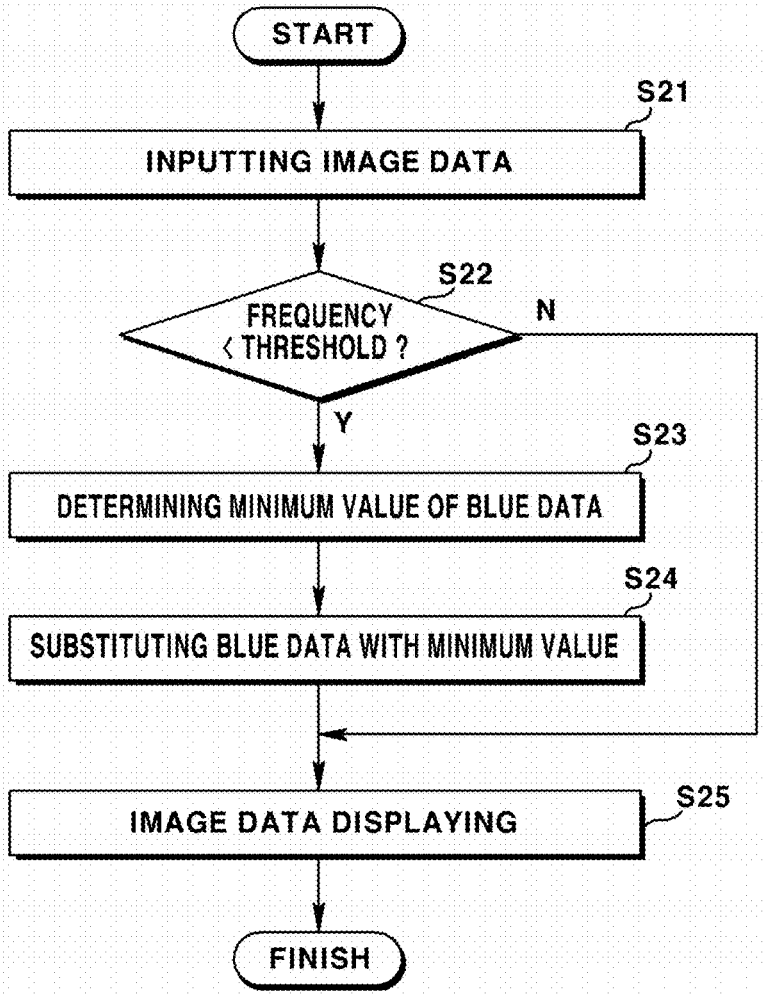
FIG. 2 is a flow chart to explain an image processing method of OLED display device according to a first exemplary embodiment of the present invention.

FIG. 2 is a flow chart to explain an image processing method of OLED display device according to a first exemplary embodiment of the present invention.

Referring to FIG. 2, the image processing method of OLED display device according to a first exemplary embodiment of the present invention may determine whether a frequency in a predetermined region of the image data is smaller than a threshold based on 2×2 pixel when an image is received (S22). At this time, although the first exemplary embodiment of the present invention has exemplified a 2×2 pixel, it should be apparent that the number of pixels at a predetermined region can be changed.

In order to decrease the power consumption according to the present invention, blue data of a predetermined region (2×2 pixel) is changed, and because details on a screen may be greatly distorted by an image processing at a border area of images or at a region of high sharpness, a selective application is used in the present exemplary embodiment. To this end, a high frequency region and a low frequency region are divisibly applied.

Figure 3:
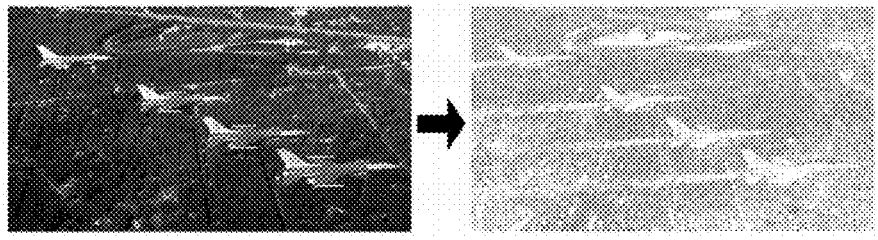
FIG. 3 is an exemplary view to illustrate a high frequency region divided in response to an original image.

FIG. 3 is an exemplary view to illustrate a high frequency region classified in response to an original image.

Referring to FIG. 3, it is possible to divide a high frequency region and a low frequency region of an original image, such that a threshold is proposed in the present invention to perform an image processing only on a frequency region lower than a relevant frequency.

That is, a minimum value of each pixel of blue data is determined for a frequency of 2×2 pixel smaller than a threshold (S23), and four blue data of each pixel may be substituted with a minimum value of blue data of relevant region (S24). That is, the data of high frequency region in the present invention is bypassed to minimize degradation of screen quality, and the data of low frequency region is to decrease power consumption by minimizing the blue data.

Figure 4:
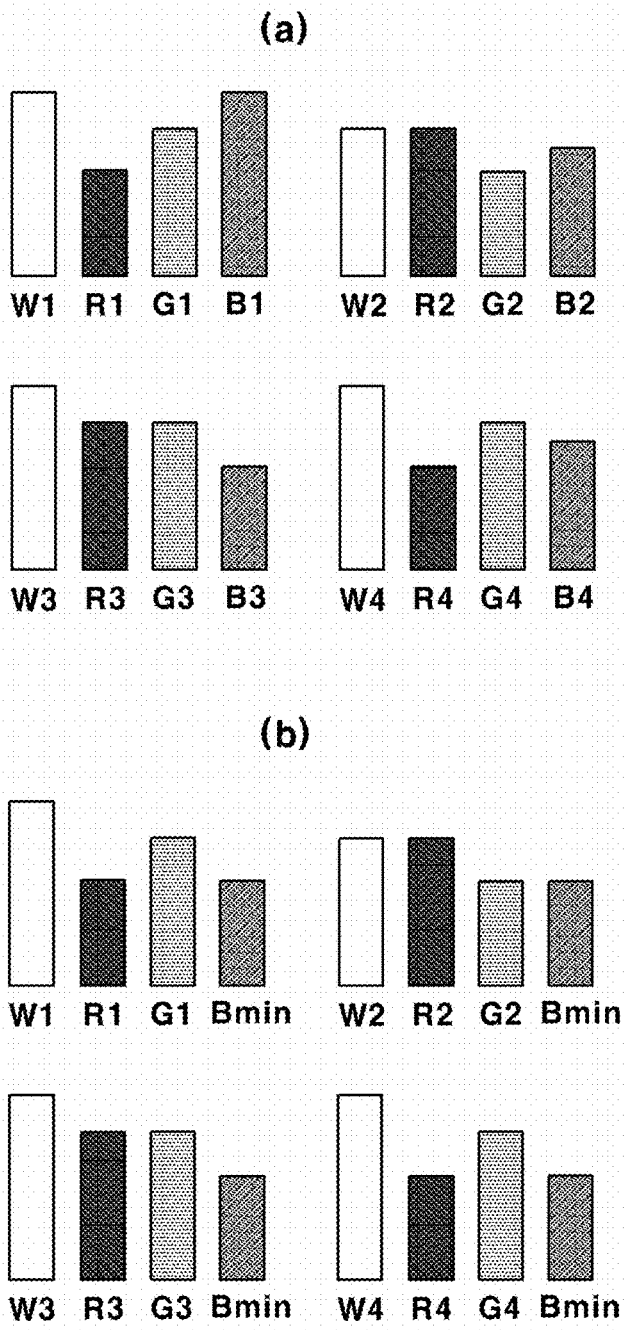
FIG. 4 is an exemplary view to explain minimization of blue data in a 2×2 pixel region according to a first exemplary embodiment of the present invention.

FIG. 4 is an exemplary view to explain minimization of blue data in a 2×2 pixel region according to a first exemplary embodiment of the present invention.

Referring to FIG. 4(*a*), one pixel may include WRGB data, which, however, explains a case of OLED display device, and it should be apparent to the skilled in the art that RGB data can be also included. In 2×2 pixel region configured as illustrated in FIG. 4(*a*), a minimum value of blue (B) data may be determined (B3 is Bmin in the exemplary embodiment of the present invention), and the blue data of 2×2 pixel region may be substituted with a relevant minimum value. As discussed above, display can be conducted by outputting an image data substituted by the blue data (S25).

Although the present invention has explained a limitation to 2×2 pixel as a region for substituting the blue data by determining a minimum value of blue data for convenience sake, the present invention is not limited thereto, and it should be apparent to the skilled in the art that a relevant region can be changed in response to characteristics in image and display device.

As discussed above, the present invention is configured in a manner such that, in a region divided as a high frequency by a threshold, a data is bypassed to minimize degradation of screen quality and in a region divided as a low frequency by a threshold, blue data is minimized to decrease the power consumption.

Figure 5:
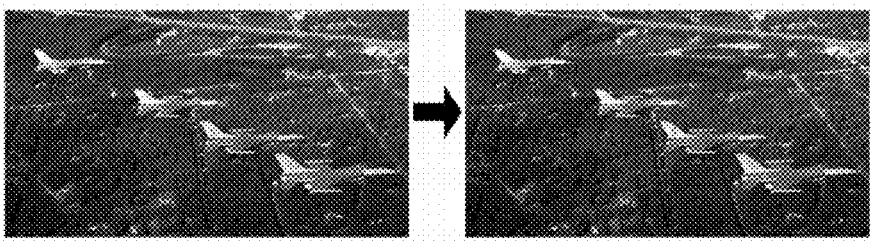
FIG. 5 is an exemplary view of an image data reduced in power consumption according to the present invention.

FIG. 5 is an exemplary view of an image data reduced in power consumption according to the present invention.

Referring to FIG. 5, it can be noted that a color temperature is changed through optimization of blue data in a low frequency region free from degradation of screen quality at a high frequency region, through which maximum 10% of power consumption can be decreased in response to characteristic of display device.

Figure 6:
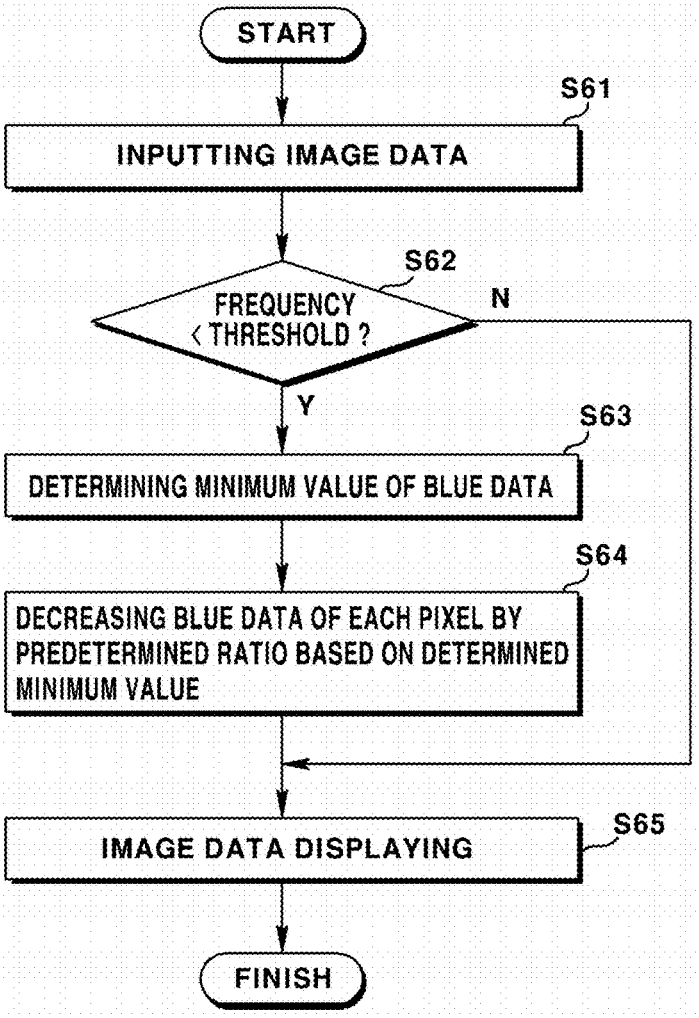
FIG. 6 is a flowchart to explain an image processing method of OLED display device according to a second exemplary embodiment of the present invention.
Figure 7:
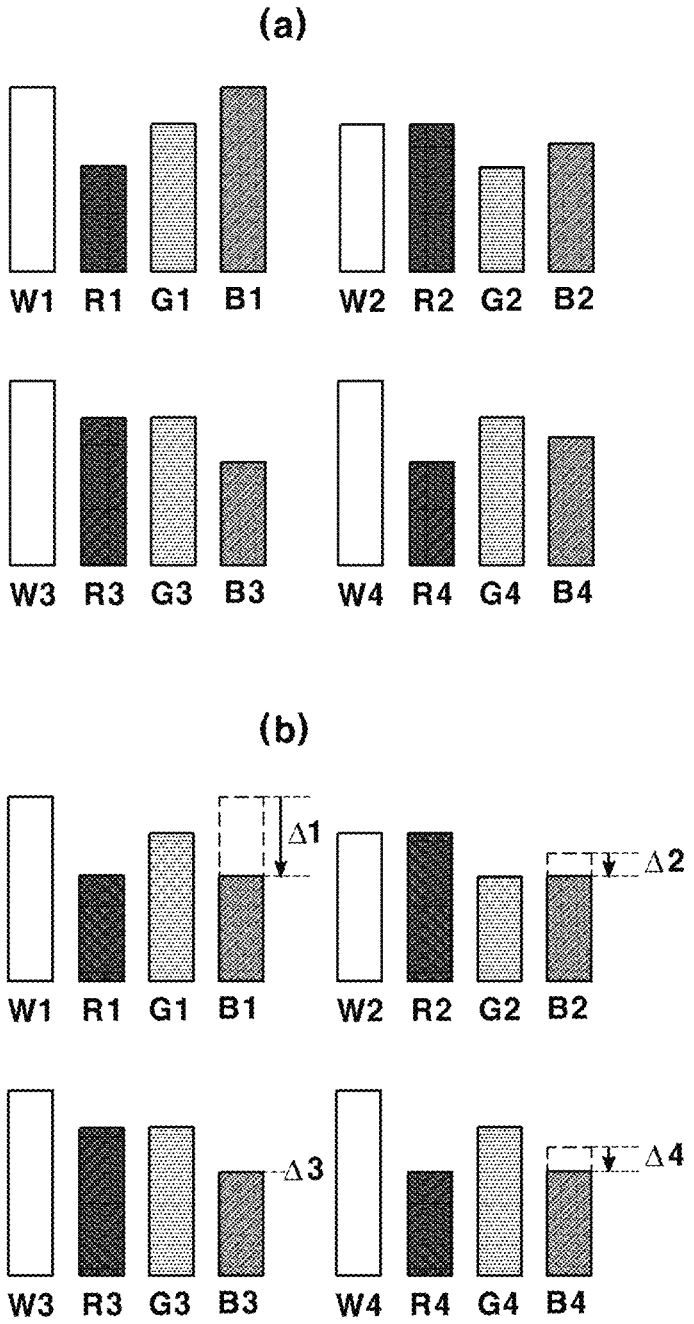
FIG. 7 is an exemplary view to explain minimization of blue data in a 2×2 pixel region according to a second exemplary embodiment of the present invention.

FIG. 6 is a flowchart to explain an image processing method of OLED display device according to a second exemplary embodiment of the present invention, and FIG. 7 is an exemplary view to explain minimization of blue data in a 2×2 pixel region according to a second exemplary embodiment of the present invention.

Referring to FIG. 6, when an image data is inputted (S61), determination is made as to whether a frequency of relevant region is smaller than a threshold based on 2×2 pixel (S62). At this time, as a result of determination at S62, if the frequency of relevant region is smaller than a threshold based on 2×2 pixel (S62—Yes), a minimum value of blue data at each pixel is determined (S63), four blue data of each pixel is decreased by a predetermined ratio based on the determined minimum value (S64), and image data including the decreased blue data is displayed (S65).

Meantime, as a result of determination at S62, if the frequency of relevant region is not smaller than a threshold based on 2×2 pixel (S62—No), the inputted image data is displayed (S65).

At this time, when blue data of each pixel is decreased at a predetermined ration according to S64, the decrease ratio may be differentially applied in response to relative size of blue data of each pixel as illustrated in FIG. 7.

FIG. 7(*a*) is an exemplary view of a color data of each pixel before the change, and FIG. 7(*b*) is an exemplary view of a color data of each pixel after the change.

In FIG. 7(*a*), the relative size of blue data of each pixel is B1>B2>B4>B3, such that the order of size of decreased ratio of each pixel data is B1 (Δ1)>B2 (Δ2)>B4 (Δ4)>B3 (Δ3)>, after the blue data B3 is determined as a minimum value, and the color data after S64 is as per FIG. 7(*b*). For example, let's assume that size of blue data B1 is 100, size of blue data B2 is 85, size of blue data B3 is 60, and size of blue data B4 is 75. Thus, the minimum value of blue data determined in response to S63 may be determined at 60, size of blue data B1 may be 80 (minus 20) after S64, size of blue data B2 may be 70 (minus 15), size of blue data B3 may be un-decreased 60 because of minimum size, and size of blue data B4 may be 65 (minus 10). Of course, the decreased ratio thus discussed is one example in order to explain the present invention, and the decreased size ratio of blue data is not limited thereto, and may be variably set up.

Meantime, although the decrease in blue data may be advantageous in the aspect of decrease in power consumption, the disadvantage is that a high screen quality distortion may be generated if the decrease in blue data is excessive, such that there is a need to adequately select the decrease ratio of the blue data.

Figure 8:
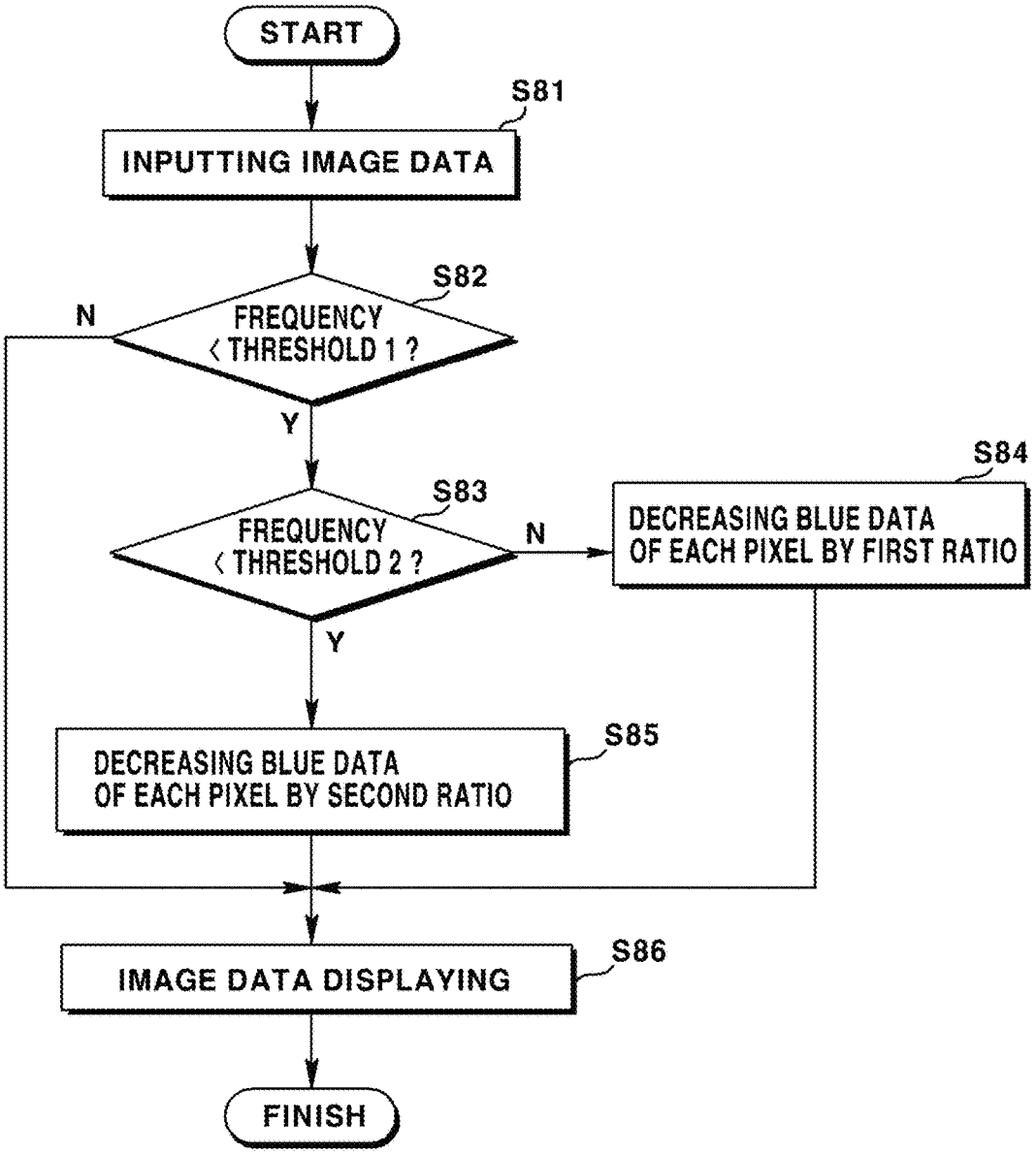
FIG. 8 is a flowchart to explain an image processing method of OLED display device according to a third exemplary embodiment of the present invention.

FIG. 8 is a flowchart to explain an image processing method of OLED display device according to a third exemplary embodiment of the present invention.

Referring to FIG. 8, when an image data is inputted (S81), determination is made as to whether a frequency of relevant region is smaller than a first threshold based on 2×2 pixel (S82). At this time, as a result of determination at S82, if the frequency of relevant region is not smaller than the first threshold based on 2×2 pixel (S82—No), the inputted image data is displayed (S86). As a result of determination at S82, if the frequency of relevant region is smaller than the first threshold (A82—Yes), determination is made as to whether the frequency of relevant region is smaller than a second threshold (S83). At this time, the second threshold is smaller than the first threshold.

At this time, as a result of determination at S83, if the frequency of relevant region is not smaller than the second threshold (S83—No), blue data of each pixel is decreased at a first ratio (e.g., 20%), (S84), the image data including the decreased blue data is displayed (S86).

Meantime, as a result of determination at S83, if the frequency of relevant region is smaller than the second threshold (S83—Yes), blue data of each pixel is decreased at a second ratio (e.g., 15%), (S85), the image data including the decreased blue data is displayed (S86).

Hence, an image processing method of OLED display device according to the third exemplary embodiment of the present invention is that a frequency of a predetermined region relative to an inputted image data is compared with a plurality of thresholds, where the decrease ratio of blue data of each pixel may vary in response to comparative result. That is, the decrease ratio of blue data for each pixel may be differentially applied in response to the frequency of a predetermined region of the input image data.

Although the third exemplary embodiment of the present invention has explained an example of comparing a frequency with two thresholds (first threshold and second threshold), it should be apparent that the threshold compared with the frequency is not limited to two thresholds, and more number of thresholds may be set up.

Meantime, although the decrease in blue data may be advantageous in the aspect of decrease in power consumption, the disadvantage is that a high screen quality distortion may be generated if the decrease in blue data is excessive, such that there is a need to adequately select the decrease ratio of the blue data.

Figure 9:
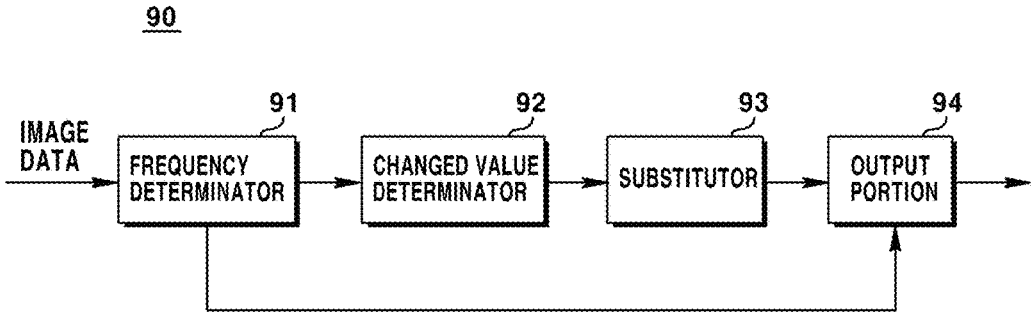
FIG. 9 is a block diagram illustrating an image processing method of OLED display device according to an exemplary embodiment of the present invention.

FIG. 9 is a block diagram illustrating an image processing method of OLED display device according to an exemplary embodiment of the present invention.

Referring to FIG. 9, an OLED image processing device according to the present invention may include a frequency determinator (91), a changed value determinator (92), a substitutor (93) and an output part (94).

The frequency determinator (91) may determine a frequency for each region of inputted image data based on a predetermined threshold. That is, determination can be made as to whether a frequency is smaller than a predetermined threshold from a predetermined region (2×2 pixel region) of the inputted image data. According to the said determination, the frequency determinator (91) may bypass the frequency to the output part (94) when the frequency is greater than the predetermined threshold, and the frequency determinator (91) may output the frequency to the changed value determinator (92) when the frequency is smaller than a predetermined threshold.

Furthermore, although the frequency determinator (91) may compare the frequency with one threshold according to set state as illustrated in FIG. 2, the frequency may be segmented ted by comparing with a plurality of thresholds as illustrated in FIG. 8.

The changed value determinator (92) may determine a blue data and a changed value of blue data based on set state by ascertaining the blue data from the data of a inputted predetermined region (2×2 pixel region). That is, the changed value determinator (92) may determine a minimum value of blue data as a changed value, may determine the blue data of each pixel as a changed value for decreasing at a predetermined ratio, or may determine the blue data of each pixel for each frequency at a predetermined ratio.

The substitutor (93) may substitute the blue data out of the data of predetermined region with a substituted value determined by the changed value determinator (92). The output part (94) may output an image data changed in color temperature by the data bypassed by the frequency determinator (91) and the data substituted with the blue data by the substitutor (93).

According to the present invention, the power consumption can be decreased and luminance can be enhanced through optimization of blue data at a low frequency region free from degradation of screen quality at a high frequency region.

The previous description of the present invention is provided to enable any person skilled in the art to make or use the invention. Various modifications to the invention will be readily apparent to those skilled in the art, and the generic principles defined herein may be applied to other variations without departing from the spirit or scope of the invention. Thus, the invention is not intended to limit the examples described herein, but is to be accorded the widest scope consistent with the principles and novel features disclosed herein.

The present invention has an industrial applicability in that it can be applied to OLED display device in order to decrease power consumption of an OLED display device.

The invention claimed is:

1. An image processing method of OLED display device, the method comprising:

receiving an image data;

determining whether a frequency in a predetermined region of the image data is smaller than a threshold;

determining a minimum value out of a plurality of blue data in the predetermined region when the frequency in the predetermined region is smaller than the threshold as a result of the determination; and changing the blue data of the predetermined region based on the determined minimum value, wherein the predetermined region is comprised of a plurality of pixels, and the step of changing the blue data of the predetermined region based on the determined minimum value includes changing each blue data of the plurality of pixels with the minimum value.

2. The method of claim 1, further comprising displaying an image data of the predetermined region when the frequency of the predetermined region is greater than the threshold as a result of the determination.

3. The method of claim 1, further comprising displaying an image data of the predetermined region including the blue data changed in response to the changing step.

4. The method of claim 1, wherein the step of changing the blue data of the predetermined region based on the determined minimum value includes changing the blue data of the predetermined region to the minimum value en bloc.

5. The method of claim 1, wherein the step of changing the blue data of the predetermined region based on the determined minimum value includes changing the blue data of the predetermined region by differentially applying in response to a size of the each blue data based on the minimum value.

6. An image processing method of OLED display device, the method comprising:

receiving an image data;

determining whether a frequency in a predetermined region of the image data is smaller than a predetermined first threshold;

determining whether the frequency in the predetermined region is smaller than a predetermined second threshold when the frequency in the predetermined region is smaller than the predetermined first threshold, as a result of determining whether the frequency of the predetermined region of the image data is smaller than the predetermined first threshold; and decreasing the blue data of the predetermined region by a predetermined ratio in response to a result of determining whether the frequency of the predetermined region is smaller than the predetermined second threshold.

7. The method of claim 6, further comprising displaying the image data of the predetermined region when the frequency of the predetermined region is smaller than the predetermined first threshold as a result of determining whether the frequency of the predetermined region of the image data is smaller than the predetermined first threshold.

8. The method of claim 6, wherein the step of decreasing the blue data of the predetermined region by the predetermined ratio includes decreasing the blue data of the predetermined region by a first ratio when the frequency of the predetermined region is not smaller than the predetermined second threshold, and decreasing the blue data of the predetermined region by a second ratio when the frequency of the predetermined region is smaller than the predetermined second threshold.

9. The method of claim 6, wherein the second threshold is smaller than the first threshold.

10. The method of claim 6, wherein the predetermined region is comprised of a plurality of pixels, and the step of decreasing the blue data of the predetermined region by the predetermined ratio includes decreasing each blue data in the plurality of pixels by the predetermined ratio.

11. An image processing method of OLED display device, the method comprising:

receiving an image data;

determining whether a frequency in a predetermined region of the image data is smaller than a threshold;

determining a first value of blue data corresponding to the predetermined region based on the frequency in the predetermined region; and changing the blue data of the predetermined region based on the determined first value, wherein the predetermined region is comprised of a plurality of pixels, and the step of changing the blue data of the predetermined region based on the determined first value includes changing each blue data of the plurality of pixels with the first value.

* * * * *